US007386914B2

(12) United States Patent
Cruzan

(10) Patent No.: US 7,386,914 B2
(45) Date of Patent: Jun. 17, 2008

(54) DRYWALL EDGE SHAPING TOOL

(75) Inventor: Donald B. Cruzan, Carmichael, CA (US)

(73) Assignee: Elixir Industries, Mission Viejo, CA (US)

( * ) Notice: Subject to any disclaimer, the term of this patent is extended or adjusted under 35 U.S.C. 154(b) by 0 days.

(21) Appl. No.: 11/277,271

(22) Filed: Mar. 23, 2006

(65) Prior Publication Data

US 2006/0230568 A1 Oct. 19, 2006

Related U.S. Application Data

(60) Provisional application No. 60/671,701, filed on Apr. 15, 2005.

(51) Int. Cl.
*A47L 13/38* (2006.01)

(52) U.S. Cl. ..... 15/235.7; 15/105.5; 15/236.01; 15/236.07; 15/236.09

(58) Field of Classification Search ..... None
See application file for complete search history.

(56) References Cited

U.S. PATENT DOCUMENTS

| | | | | |
|---|---|---|---|---|
| 5,368,461 | A * | 11/1994 | Murphy | 425/87 |
| 5,392,484 | A | 2/1995 | Stoltzfus | |
| 5,440,776 | A | 8/1995 | Kartler | |
| 5,638,570 | A | 6/1997 | Gruner | |
| 2003/0192142 | A1 * | 10/2003 | Veith | 15/235.4 |

* cited by examiner

*Primary Examiner*—David A Redding

(57) ABSTRACT

A drywall edge shaping tool for cleaning and shaping bullnose corners is made out of aluminum flat stock. The tool has two shaping heads, one at each end, each shaping head having a concave shaping surface that is tilted at approximately forty-five degrees from the center line of the tool. The shaping edge of each shaping surface may be sized differently to accommodate different size bullnose corners. A putty knife cleaning groove is located behind each shaping head of the tool.

17 Claims, 1 Drawing Sheet

DRYWALL EDGE SHAPING TOOL

BACKGROUND OF THE INVENTION

1. Field of the Invention

The present invention relates generally to the field of construction and more particularly, to a hand tool for use by drywallers in shaping and cleaning corners in a drywall installation.

2. Description of Related Art

The finishing of interiors of residences and business establishments by drywall sheets has evolved to utilizing bullnose corners. These bullnose corners are made by utilizing a curved metal strip placed between two drywall sheets that meet at a protruding angle. A finishing compound is then applied over the metal strip before the drywall is painted. Typical angles for these corners are 90° and 135°. Besides forming bullnose corners at the meeting point of two walls, bullnose corners are also sometimes formed on drywall adjacent a door jamb.

Tools that permit a drywall finisher to finish bullnose joints have been devised. U.S. Pat. No. 5,392,484 granted Feb. 28, 1995 to John Stoltzfus for Bullnose Corner Cleaning Tool shows a handheld tool having a single working head at one end of a handle. The head is generally formed as a section of a thin-walled hollow cylinder having a concave side and convex side. The single head working portion is configured to finish drywall joints of different angles. The head includes a curved recess for finishing a bullnose joint. U.S. Pat. No. 5,638,570 granted Jun. 17, 1997 to Glen A. Gruner for a Drywall Bullnose Cleaner Tool, shows a handheld tool that has an elongated handle portion with first and second end portions. Both end portions are shaped to match a bullnose corner. One end portion is shaped in a 75° arc to match a 90° bullnose corner joint. The second end portion is shaped in a 50° arc that matches a 135° bullnose corner joint. U.S. Pat. No. 5,440,776 granted Aug. 15, 1995 to Michael Kartler for a Corner Finishing System, shows an applicator tool for applying joint compound to corners. The tool has a handle and a head. The head is curved. The handle and head are integrally formed from plastic material. A flexible blade projects from the forward edge of the head which is used to smooth a compound into a drywall corner.

Although these tools are functional to accomplish their general purpose of applying compound material to drywall bullnose corner joints, each of them have the shaping surface lined up on the axis with the handle, so that when the tool is moved downward or upward against the corner, it is difficult to see exactly what the tool is doing until after the tool has passed the contact spot. Thus, there still exists a need for an improved tool for cleaning and shaping bullnose corners that will allow the user to see what the tool is doing at the point of contact.

SUMMARY OF THE INVENTION

A drywall edge shaping tool having an edge shaping head at each end of a hand held tool with each shaping head having a shaping surface offset from the handle by forty-five degrees. The concave-shaped blade of the shaping surface on each head may be different in size to accommodate different size bullnose corners. A putty knife cleaning groove behind one or both of the shaping heads permits easy cleaning of drywall mud from the blade of a putty knife.

BRIEF DESCRIPTION OF THE DRAWINGS

The exact nature of this invention, as well as the objects and advantages thereof, will become readily apparent from consideration of the following specification in conjunction with the accompanying drawings in which like reference numerals designate like parts throughout the figures thereof and wherein.

DETAILED DESCRIPTION OF THE PREFERRED EMBODIMENTS

Figure 1:
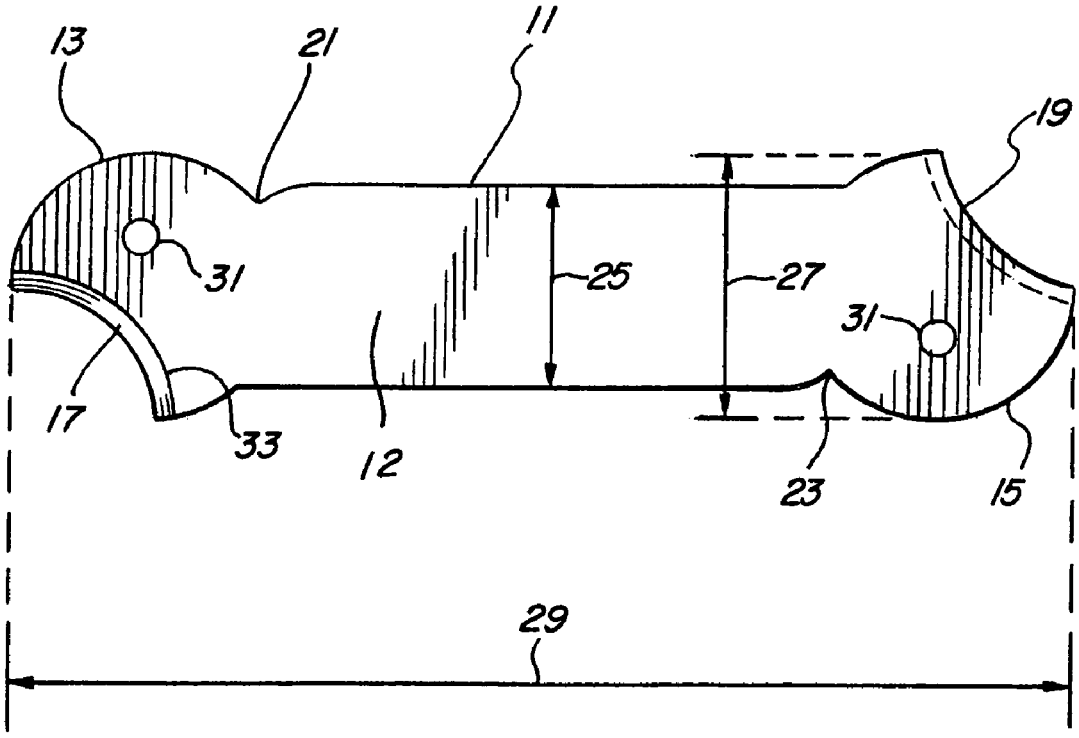
FIG. 1 is a plane view of the preferred embodiment of the invention.

The drywall edge shaping tool 11 of the present invention is preferably made out of a single piece of aluminum stock which is approximately ⅛ of an inch thick. In one embodiment, tool 11 is about 6 inches long in overall length 29, has an overall width 27 of about 1½ inches, and a handle width 25 of 1⅛ inches.

Two shaping heads 13 and 15 are formed, one at either end of the handle 12 of the tool 11. Each shaping head 13, 15 has a respective concave shaping surface 17, 19, which may be formed into a knife edge 33. As shown in FIG. 1, the knife edge 33 of concave shaping surface 17 may form a beveled edge sloping outwardly from the facing side of tool 11 to the opposite side of tool 11. An opposing beveled edge may be formed on concave shaping surface 19 that slopes outwardly from the opposite side of tool 11 to the facing side of tool 11, as indicated by the dashed lines. The concave shaping surfaces 17 and 19 are adapted to fit the different size bullnose corners used in today's drywall industry. For example, one concave surface 17 would have at a 50° angle span to handle a 135° corner joint. The other concave surface 19 would have a 75° angle span to handle a 90° bullnose corner joint.

Each shaping head 13 and 15 with its concave shaping edges 17 and 19, respectively, are set at an angle to the centerline for the handle portion 12 of the shaping tool 11. The applicant has found through experimentation that the shaping head and its concave shaping surface perform best when the shaping head is at an angle of 45 degrees to the centerline of the shaping tool 11. As shown in FIG. 1, the 45 degree offset angle of concave shaping surface 17 may be about 180 degrees opposite the 45 degree offset angle of concave shaping surface 19.

At this angle, a user of the tool is holding it in a manner which allows him to see the point of contact of the shaping edge 33 with the bullnose corner, providing a clear view of the corner being formed. This gives the user better control during the corner-forming process as the tool is drawn down or up against each corner.

An additional feature of the drywall edge-shaping tool of the present invention is a pair of v-shaped grooves 21 and 23, placed respectively behind the shaping heads 13 and 15 of the tool 11. These v-shaped grooves facilitate the scraping of drywall joint compound from the blades of putty knives used by a drywall finisher, in conjunction with the tool of the present invention. These v grooves are preferably ⅛ to ½ inch deep and may be any other convenient size, depending on the size of the blades of the putty knives being utilized. As shown in FIG. 1, one or both of grooves 21, 23 may be formed on tool 11 at a junction of handle 12 and a corner shaping head 13 or 15 on an edge opposite a concave shaping surface 17 or 19, respectively.

A pair of holes 31 are located in the drywall edge-shaping tool 11. These holes are preferably 3⁄16 inches diameter and provide a convenient attachment mechanism for a lanyard to strap the tool to a worker's tool belt or to hang on a hook for display in a store.

The above described preferred embodiment of the drywall edge-shaping tool overcomes the disadvantage in prior art drywall bullnose corner shaping tools by offsetting each shaping head on the tool by an angle, preferably at 45°.

What is claimed is:

1. A drywall edge shaping tool comprising:

a handle having a length-to-width ratio of about two and two-thirds to one;

a first corner shaping head at one end of the handle, the first corner shaping head having a concave shaping surface offset by an angle from a longitudinal axis of the handle, the concave shaping surface matching a drywall edge to be shaped; and a second corner shaping head at an opposite end of the handle, the second corner shaping head having a concave shaping surface offset by an angle from the longitudinal axis.

2. The drywall edge shaping tool of claim 1 wherein the concave shaping surface of the first corner shaping head and the concave shaping surface of the second corner shaping head are offset by an angle of about forty-five degrees.

3. The drywall edge shaping tool of claim 1 further comprising a groove formed at a junction of the handle and the first corner shaping head on an edge opposite the concave shaping surface of the first corner shaping head for cleaning drywall mud from a blade of a putty knife.

4. The drywall edge shaping tool of claim 3 further comprising a second groove formed at a junction of the handle and the second corner shaping head on an edge opposite the concave shaping surface of the second corner shaping head for cleaning drywall mud from a blade of a putty knife.

5. The drywall edge shaping tool of claim 1 wherein the handle and corner shaping heads are formed from a single piece of aluminum.

6. The drywall edge shaping tool of claim 1 further comprising an aperture in the handle for passing a lanyard.

7. The drywall edge shaping tool of claim 2 wherein the handle and corner shaping heads are made from a single piece of aluminum.

8. The drywall edge shaping tool of claim 3 wherein the handle and corner shaping heads are made from a single piece of aluminum.

9. The drywall edge shaping tool of claim 4 wherein the handle and corner shaping heads are made from a single piece of aluminum.

10. A drywall edge shaping tool, comprising:

a handle having a total length and an overall width;

a first corner shaping head at one end of the handle, the first corner shaping head having a concave shaping surface offset by an angle from a longitudinal axis of the handle, the concave shaping surface matching a drywall edge to be shaped; and a second corner shaping head at an opposite end of the handle, the second corner shaping head having a concave shaping surface offset by an angle from the longitudinal axis;

wherein a total length of the tool is about four times its overall width.

11. The drywall edge shaping tool of claim 10 wherein the first corner shaping head defines the overall width of the tool.

12. The drywall edge shaping tool of claim 1 wherein a width of the first corner shaping head exceeds a width of the handle.

13. The drywall edge shaping tool of claim 1 wherein the concave shaping surface of the first corner shaping head comprises a beveled edge sloping outwardly from a first side of the tool to a second side of the tool opposite the first side of the tool.

14. The drywall edge shaping tool of claim 13 wherein the concave shaping surface of the second corner shaping head has a beveled edge sloping outwardly from the second side of the tool to the first side of the tool.

15. The drywall edge shaping tool of claim 1 wherein the offset angle of the concave shaping surface of the first corner shaping head is about 180 degrees from the offset angle of the concave shaping surface of the second corner shaping head.

16. A drywall edge shaping tool comprising:

a rectangular handle having a first side, a second side opposite the first side, and a length-to-width ratio of about two and two-thirds to one;

a first corner shaping head at one end of the handle, the first corner shaping head having a concave shaping surface offset by an angle of about 45 degrees from a longitudinal axis of the handle, the concave shaping surface of the first corner shaping head having a beveled edge sloping outwardly from the first side of the handle to the second side of the handle;

a second corner shaping head at an opposite end of the handle, the second corner shaping head having a concave shaping surface offset by an angle about 180 degrees with respect to the offset angle of the concave shaping surface of the first corner shaping head, the concave shaping surface of the second corner shaping head having a beveled edge sloping outwardly from the second side of the handle to the first side of the handle; and a groove formed at a junction of the handle and one of the first and second corner shaping heads for cleaning a blade of a putty knife.

17. The drywall edge shaping tool of claim 16 wherein the handle and corner shaping heads are made from a single piece of aluminum.

* * * * *